US006889511B2

(12) United States Patent
Jung

(10) Patent No.: US 6,889,511 B2
(45) Date of Patent: May 10, 2005

(54) TEMPERATURE CONTROL DEVICE FOR REFRIGERATING APPARATUS AND METHOD THEREOF

(75) Inventor: Jin Ho Jung, Busan (KR)

(73) Assignee: LG Electronics Inc., Seoul (KR)

( * ) Notice: Subject to any disclaimer, the term of this patent is extended or adjusted under 35 U.S.C. 154(b) by 8 days.

(21) Appl. No.: 10/352,944

(22) Filed: Jan. 29, 2003

(65) Prior Publication Data

US 2003/0145617 A1 Aug. 7, 2003

(30) Foreign Application Priority Data

Feb. 2, 2002 (KR) ..... 10-2002-0006073

(51) Int. Cl.[7] ..... F25B 19/00
(52) U.S. Cl. ..... 62/231; 62/264; 165/263
(58) Field of Search ..... 62/231, 229, 157, 62/158, 264; 165/263, 264, 267, 269; 236/78 B, 78 D, 46 F

(56) References Cited

U.S. PATENT DOCUMENTS 4,292,813 A * 10/1981 Paddock ..... 62/150
5,524,444 A * 6/1996 Gromala et al. ..... 236/78 D
6,223,817 B1 * 5/2001 Oden et al. ..... 165/263 X

* cited by examiner

*Primary Examiner*—Harry B. Tanner
(74) *Attorney, Agent, or Firm*—Fleshner & Kim, LLP.

(57) ABSTRACT

A temperature control device and temperature control method for a refrigerating apparatus are provided. This system calculates an operation rate of a compressor installed in the refrigerating apparatus, and controls operation of the compressor based on the calculated operation rate, thus obviating the need for an outside air temperature sensor and a damper to accurately control temperature. A heat generating lamp may be positioned in the chilling chamber to further regulate chilling chamber temperature. Operation of the heat generating lamp is also controlled based on the operation rate of the compressor.

19 Claims, 3 Drawing Sheets

TEMPERATURE CONTROL DEVICE FOR REFRIGERATING APPARATUS AND METHOD THEREOF

BACKGROUND OF THE INVENTION

1. Field of the Invention

The present invention relates to a refrigerating apparatus, and more particularly, to a temperature control device for the refrigerating apparatus and a method thereof.

2. Description of the Background Art

Generally, a refrigerating apparatus controls outside air or inside air temperature by controlling refrigerant of high temperature and high pressure which circulates along its own refrigerating cycle. The refrigerating apparatus includes a refrigerator, an air conditioner, and etc. Hereinafter, the refrigerating apparatus according to the conventional art will be explained with reference to FIG. 1.

FIG. 1 is a block diagram showing a refrigerating apparatus according to the conventional art.

As shown in FIG. 1, the conventional refrigerating apparatus comprises: a compressor 11 for compressing refrigerant; a condenser 12 for emitting refrigerant heat compressed in the compressor 11; a drier 13 installed at the condenser 12 for removing moisture in the refrigerant; a refrigerant pipe connected to the drier 13; a solenoid valve 14 connected to the refrigerant pipe for controlling opening and closing of the refrigerant pipe; an expansion valve 15 connected to the solenoid valve 14 for reducing a pressure discharged from the solenoid valve 14; and an evaporator 16 connected to the expansion valve 15 for evaporating cold air in order to absorb heat contained in food put in a freezing chamber or a chilling chamber by receiving the refrigerant having the reduced pressure. That is, the refrigerating cycle of the conventional refrigerating apparatus is formed by connecting the compressor 11, the condenser 12, the drier 13, the solenoid valve 14, the expansion valve 15, the evaporator 16, and the compressor 11 one another.

Also, the compressor 11, the condenser 12, the drier 13, the expansion valve 15, the evaporator 16, and the compressor 11 are connected to one another through the refrigerant pipe. Hereinafter, a temperature control device applied to the conventional refrigerating apparatus will be explained with reference to FIGS. 2A to 2B.

FIGS. 2A to 2B show a construction of the temperature control device of the conventional refrigerating apparatus. Herein, the FIG. 2A shows a construction of the refrigerating apparatus in which the conventional temperature control device is installed.

As shown in FIG. 2B, the temperature control device of the conventional refrigerating apparatus comprises: a temperature setting unit (not shown) for setting temperature of a chilling chamber and a freezing chamber according to a user's demand; an outside air temperature detecting sensor 21 mounted outside the refrigerating apparatus for detecting outside air temperature; a chilling chamber temperature detecting unit (not shown) for detecting temperature of the chilling chamber; a microcomputer 22 for controlling a driving of a compressor 24 and a refrigerating fan 25 to maintain temperature of the chilling chamber at temperature selected by the user and for outputting a control signal when the detected outside air temperature is low; and a heat generating lamp 23 mounted in the chilling chamber for emitting heat by the control signal of the microcomputer 22. Hereinafter, operations of the temperature control device of the conventional refrigerating apparatus will be explained.

First, the temperature setting unit outputs a temperature signal corresponding to temperature of the chilling chamber and the freezing chamber set by the user to the microcomputer 22. At this time, the temperature detecting unit installed at the chilling chamber detects temperature of the chilling chamber and outputs a temperature signal corresponding to the detected temperature to the microcomputer 22.

The microcomputer 22 drives the compressor 24 and the refrigerating fan 25 mounted in the refrigerating apparatus on the basis of the temperature detected from the chilling chamber temperature detecting unit and the temperature set by the user. That is, the microcomputer 22 drives the compressor 24 and the refrigerating fan 25 until inner temperature of the chilling chamber reaches to the temperature set by the user.

In the meantime, when outside air temperature of the refrigerating apparatus is low like in winter, the microcomputer 22 stops the compressor 24 and the refrigerating fan 25 since the outside air temperature is similar to temperature in the chilling chamber or same, that is, the temperature of the chilling chamber becomes lower than a predetermined temperature or same by the outside air temperature.

For example, the outside air temperature detecting sensor 21 for detecting the outside air temperature is installed at an outer portion of the conventional refrigerating apparatus. Also, when the outside air temperature is low like in winter, that is, the outside air temperature becomes lower than a predetermined temperature, the microcomputer 22 controls the heat generating lamp 23 so that heat can be emitted from the heat generating lamp 23. Accordingly, the conventional refrigerating apparatus detects the outside air temperature by using the outside air temperature detecting sensor 21 and thereby maintains temperature of the chilling chamber and the freezing chamber constantly and stores food.

Generally, the refrigerating apparatus supplies cold air to the freezing chamber when temperature of the freezing chamber is high and transmits the cold air to the chilling chamber through a damper installed between the freezing chamber and the chilling chamber, thereby maintaining temperature of the chilling chamber constantly.

In the meantime, in the conventional art, the refrigerating fan 25 and the compressor 24 are driven on the basis of temperature of the chilling chamber without installing the damper between the freezing chamber and the chilling chamber. Also, as long as peripheral temperature is not changed greatly, temperature of the chilling chamber and the freezing chamber are controlled by a constant cold air distribution rate. Said method has an advantage that the damper is not installed. However, external heat quantity introduced to the freezing chamber and the chilling chamber is changed even if distribution amount of the cold air is equal, so that temperature of the freezing chamber is increased even if temperature of the chilling chamber is constant. That is, the microcomputer does not drive the compressor regardless of temperature of the freezing chamber when inner temperature of the chilling chamber becomes low by low outside air temperature like in winter. Accordingly, in the conventional art, the temperature of the freezing chamber is increased even though temperature of the chilling chamber is lower than a predetermined temperature or equal, thereby damaging to food in the freezing chamber.

As aforementioned, the temperature control device of the conventional refrigerating apparatus had a problem to install the outside air temperature detecting sensor 21 for detecting outside air temperature of the refrigerating apparatus in order to maintain temperature of the chilling chamber at temperature set by the user by controlling on/off of the compressor.

Also, since the outside air temperature detecting sensor 21 applied to the temperature control device of the conventional refrigerating apparatus is installed in the refrigerating apparatus or in an outer cover of the refrigerating apparatus, outside air can not be accurately calculated.

Besides, the temperature control device of the conventional refrigerating apparatus does not drive the compressor regardless of temperature of the freezing chamber when inner temperature of the chilling chamber becomes low by low outside air temperature like in winter, thereby increasing temperature of the freezing chamber and damaging to food stored in the freezing chamber.

SUMMARY OF THE INVENTION

Therefore, an object of the present invention is to provide a temperature control device of a refrigerating apparatus and a method thereof, in which an operation rate of a compressor installed in the refrigerating apparatus is calculated and the compressor is controlled on the basis of the calculated operation rate of the compressor, thereby not needing to install outside air temperature detecting sensor and a damper and accurately controlling temperature of the refrigerating apparatus.

Another object of the present invention is to provide a temperature control device of a refrigerating apparatus and a method thereof, in which outside air temperature detecting sensor and a damper are not installed at the refrigerating apparatus, thereby reducing a fabricating cost of the refrigerating apparatus.

To achieve these and other advantages and in accordance with the purpose of the present invention, as embodied and broadly described herein, there is provided a method for controlling temperature of the refrigerating apparatus having a compressor and a heat generating lamp, the method comprising the steps of: calculating an operation rate of the compressor installed in the refrigerating apparatus; and controlling an operation of the compressor on the basis of the calculated compressor operation rate.

To achieve these and other advantages and in accordance with the purpose of the present invention, as embodied and broadly described herein, there is still provided a method for controlling temperature of the refrigerating apparatus having a compressor and a heat generating lamp, the method comprising the steps of: calculating an operation rate of the compressor installed in the refrigerating apparatus; determining whether the calculated operation rate of the compressor is less than a predetermined operation rate or not; if the calculated operation rate of the compressor is less than the predetermined operation rate, determining that peripheral temperature of the refrigerating apparatus is low and operating the compressor; and if the calculated operation rate of the compressor is more than the predetermined operation rate, operating the compressor by a temperature detecting signal of a temperature detecting unit installed in the chilling chamber and stopping an operation of the heat generating lamp. Herein, the operation rate of the compressor is determined on the basis of a rate of the temperature detecting signal of the temperature detecting unit installed in the chilling chamber of the refrigerating apparatus.

To achieve these and other advantages and in accordance with the purpose of the present invention, as embodied and broadly described herein, there is provided a temperature control device of a refrigerating apparatus comprising: a temperature detecting unit installed in the chilling chamber of the refrigerating apparatus for outputting a temperature detecting signal when temperature in the chilling chamber exceeds a predetermined temperature; a heat generating lamp mounted in the chilling chamber of the refrigerating apparatus for emitting heat according to a control signal; and a microcomputer for controlling a driving of the compressor installed in the refrigerating apparatus on the basis of the temperature detecting signal of the temperature detecting unit, calculating an operation rate of the compressor, and outputting the control signal on the basis of the calculated compressor operation rate to control the driving of the compressor.

To achieve these and other advantages and in accordance with the purpose of the present invention, as embodied and broadly described herein, there is still provided a temperature control device of a refrigerating apparatus comprising: a temperature setting unit for setting temperature of a chilling chamber and a freezing chamber according to a user's demand; a temperature detecting unit installed in the chilling chamber of the refrigerating apparatus for outputting a temperature detecting signal when temperature of the chilling chamber exceeds a predetermined temperature; a heat generating lamp mounted in the chilling chamber of the refrigerating apparatus for emitting heat according to the control signal; and a microcomputer for controlling a driving of the compressor installed in the refrigerating apparatus on the basis of the temperature detecting signal of the temperature detecting unit, calculating an operation rate of the compressor, and outputting the control signal on the basis of the calculated compressor operation rate to control the driving of the compressor. Herein, the operation rate of the compressor is determined by a rate of the temperature detecting signal outputted from the temperature detecting unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
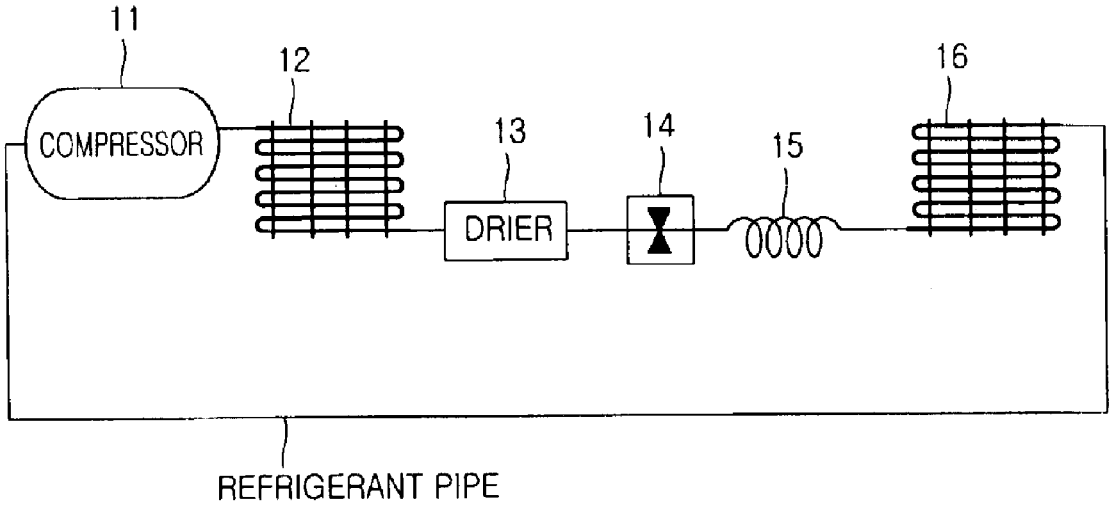
FIG. 1 CONVENTIONAL ART
FIG. 1 is a block diagram showing a refrigerating apparatus according to a conventional art.
Figure 2A:
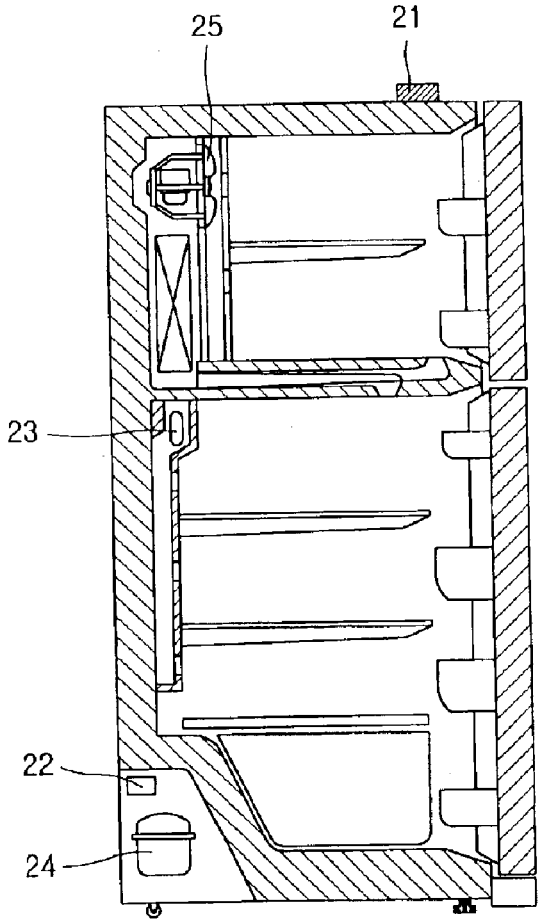
FIG. 2A CONVENTIONAL ART
FIGS. 2A to 2B show a construction of a temperature control device according to the conventional refrigerating apparatus.
Figure 2B:
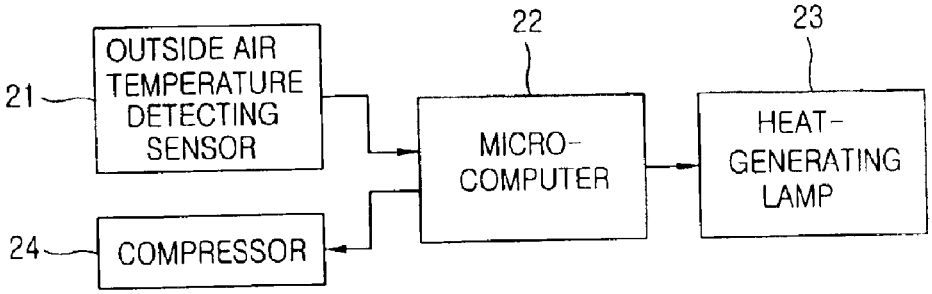
FIG. 2B CONVENTIONAL ART
Figure 3A:
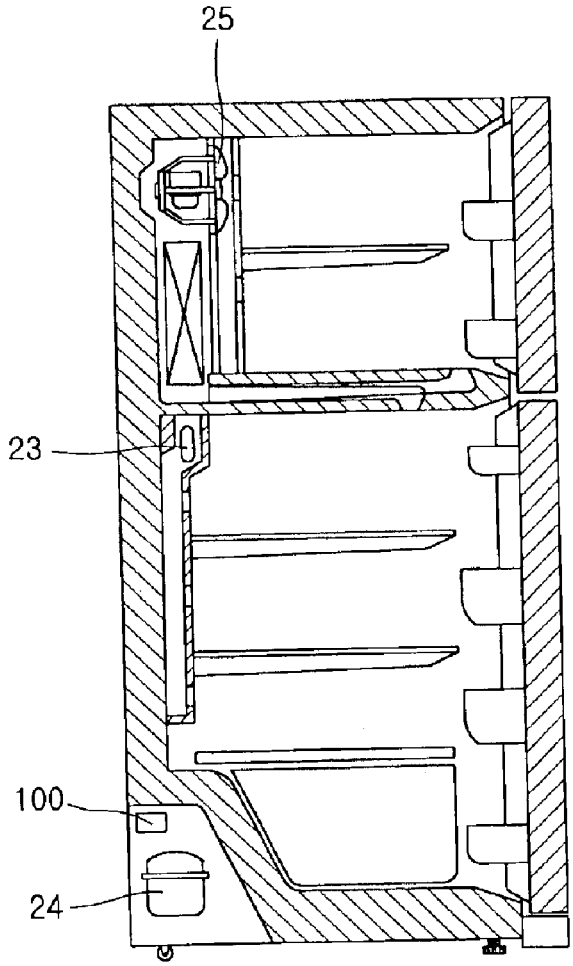
FIGS. 3A to 3B show a construction of a temperature control device of a refrigerating apparatus according to the present invention.
Figure 3B:
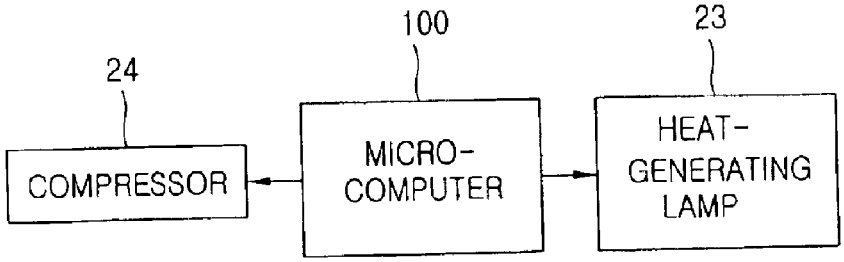

With reference to FIGS. 3A to 3B, will be explained a temperature control device of a refrigerating apparatus and a method thereof, in which an operation rate of a compressor installed in the refrigerating apparatus is calculated and the compressor is controlled on the basis of the calculated operation rate of the compressor, thereby not needing to install outside air temperature detecting sensor and a damper and accurately controlling temperature of the refrigerating apparatus.

FIGS. 3A to 3B show a construction of a temperature control device of a refrigerating apparatus according to the present invention. Herein, the FIG. 3A shows a construction of a refrigerating apparatus in which the temperature control device according to the present invention is installed. That is, the outside air temperature detecting sensor and the damper are not installed.

As shown in FIG. 3B, the temperature control device of a refrigerating apparatus according to the present invention comprises: a temperature setting unit (not shown) for setting temperature of a chilling chamber and a freezing chamber according to the user's demand; a temperature detecting unit installed in the chilling chamber of the refrigerating apparatus for outputting a temperature detecting signal when temperature of the chilling chamber exceeds a predetermined temperature; a heat generating lamp 23 mounted in the chilling chamber of the refrigerating apparatus for emitting heat according to the control signal; and a microcomputer 100 for controlling a driving of the compressor 24 on the basis of the temperature detecting signal of the temperature detecting unit, calculating an operation rate of the compressor 24, and outputting the control signal on the basis of the calculated compressor operation rate to control the driving of the compressor 24 and the refrigerating fan 25. Herein, the operation rate of the compressor is determined by a rate of the temperature detecting signal outputted from the temperature detecting unit. That is, when the rate of the temperature detecting signal is 100%, an operation rate of the compressor is 100%.

Hereinafter, operations of the temperature control device of the refrigerating apparatus according to the present invention will be explained in detail.

First, when outside air temperature is low in a method for controlling the chilling chamber of the refrigerating apparatus where the damper is not installed, inner temperature of the chilling chamber is similar or equal to peripheral temperature of the refrigerating apparatus. For example, in case that weather is cold in winter, inner temperature of the chilling chamber in the refrigerating apparatus becomes similar or equal to peripheral temperature. At this time, since temperature of the chilling chamber is lower than a predetermined temperature or equal, the compressor 24 installed in the refrigerating apparatus is sometimes not driven. That is, since the compressor 24 of the refrigerating apparatus is not operated because the temperature in the chilling chamber is lower than the predetermined temperature or equal by the outside air temperature, temperature of the freezing chamber is drastically increased even though temperature in the chilling chamber is less than the predetermined temperature or equal, thereby damaging to food stored in the freezing chamber.

Accordingly, to prevent temperature of the freezing chamber from being increased, the microcomputer 100 calculates an operation rate of the compressor 24 installed in the refrigerating apparatus, determines that the peripheral temperature of the refrigerating apparatus is low if the calculated operation rate of the compressor is less than the predetermined operation rate, outputs a control signal to the heat generating lamp 23, receives the temperature detecting signal from the temperature detecting unit which outputs the temperature detecting signal by detecting the temperature of the chilling chamber increased by the heat generating lamp 23, and operates the compressor 24 on the basis of the received temperature detecting signal, thereby lowering the temperature of the freezing chamber.

Herein, it is preferable that the predetermined operation rate of the compressor is 10%. For example, when the compressor 24 is operated for 17 minutes and is not operated for the remaining 43 minutes during one hour, the microcomputer 100 calculates the operation rate of the compressor 24 as approximately 28.4%. At this time, the microcomputer 100 operates the heat generating lamp 23 when the calculated compressor operation rate (28.4%, in this instance) is less than or equal to the predetermined compressor operation rate of 10%, and operates the compressor 24 according to a rate of the temperature detecting signal. That is, the lower the peripheral temperature is, the less external heat quantity introduced to the refrigerating apparatus is. According to this, the rate of the temperature detecting signal output to the microcomputer 100 from the temperature detecting unit installed in the chilling chamber is decreased.

As another example, when the rate of the temperature detecting signal outputted to the microprocessor computer 100 from the temperature detecting unit is supposed to be 10% under a condition that the peripheral temperature is 5° C., the operation rate of the compressor also becomes 10%. At this time, when one hour is supposed to be 100%, the compressor is operated for approximately 17 minutes. That is, the microcomputer calculates the operation rate of the compressor, infers outside air temperature of the refrigerating apparatus on the basis of the calculated operation rate and the predetermined operation rate, determines that the peripheral temperature is low when the compressor operation rate is 10%, and increases temperature of the chilling chamber by outputting the control signal to the heat generating lamp 23 so that heat can be emitted from the heat generating lamp 23. Also, the temperature detecting unit outputs the temperature detecting signal to the microcomputer 100 in accordance with that temperature of the chilling chamber is increased. According to this, the microcomputer 100 operates the compressor 24 on the basis of the temperature detecting signal to lower temperature of the freezing chamber.

In the meantime, the microcomputer 100 determines that the peripheral temperature is high when the calculated operation rate of the compressor is more than the predetermined operation rate of the compressor, and controls the operation of the compressor 24 according to the temperature detecting signal of the temperature detecting unit.

For example, under a presumption that the predetermined compressor operation rate is 10%, when the compressor is operated for 30 minutes and is not operated for the rest 30 minutes, the operation rate of the compressor is calculated as 50%. At this time, since the calculated compressor operation rate 50% is more than the predetermined compressor operation rate 10%, the microcomputer 100 operates the compressor 24 according to the temperature detecting signal of the temperature detecting unit. That is, when the rate of the temperature detecting signal of the temperature detecting unit is supposed to be 55% under a condition that the peripheral temperature of the refrigerating apparatus is 30° C., the higher the peripheral temperature is, the more the external heat quantity introduced to the refrigerating apparatus is. According to this, the rate of the temperature detecting signal is increased. Therefore, the microcomputer 100 operates the compressor by the rate of the temperature detecting signal generated from the temperature detecting unit.

As aforementioned, in the present invention, the compressor operation rate is calculated and the operation of the compressor is controlled on the basis of the calculated compressor operation rate, thereby not needing to install the outside air temperature detecting sensor and the damper and accurately controlling temperature of the freezing chamber.

Also, in the present invention, since the damper and the outside air temperature detecting sensor are not installed to the refrigerating apparatus, a fabricating cost for the refrigerating apparatus is reduced.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A method for controlling temperature of a freezing chamber and a chilling chamber of a refrigerating apparatus having a compressor and a heat generating lamp, the method comprising:

calculating an operation rate of the compressor installed in the refrigerating apparatus;

comparing the calculated compressor operation rate to a predetermined compressor rate;

controlling operation of the compressor based on the comparison of the calculated compressor operation rate and the predetermined compressor operation rate; and operating a heat generating lamp installed in the chilling chamber based on the calculated compressor operation rate.

2. The method of claim 1, wherein controlling the operation of the comprises determining that a peripheral temperature of the refrigerating apparatus is low and operating the compressor when the calculated operation rate of the compressor is less than the predetermined operation rate of the compressor.

3. The method of claim 2, further comprising operating the compressor based on a temperature detecting signal from a temperature detecting unit installed in the chilling chamber, and stopping operation of the heat generating lamp when the calculated operation rate of the compressor is greater than the predetermined operation rate of the compressor.

4. The method of claim 1, wherein calculating an operation rate of the compressor comprises determining an operation rate based on a rate transmitted by the temperature detecting signal from the temperature detecting unit.

5. The method of claim 1, further comprising:

operating the heat generating lamp and the compressor when the calculated compressor operation rate is greater than or equal to the predetermined compressor operation rate;

stopping operation of the heat generating lamp when the calculated compressor operation rate is less than the predetermined compressor operation rate; and controlling continued operation of the compressor based on a temperature detecting signal generated by a temperature detecting unit provided in the chilling chamber of the refrigerating apparatus.

6. A temperature control device of a refrigerating apparatus, comprising:

a temperature detecting unit installed in a chilling chamber of a refrigerating apparatus and configured to output a temperature detecting signal when a temperature in the chilling chamber exceeds a predetermined temperature;

a microcomputer configured to control a driving of a compressor installed in the refrigerating apparatus based on the temperature detecting signal output by the temperature detecting unit, and to calculate an operation rate of the compressor and output a control signal based on a comparison of the calculated compressor operation rate and a predetermined compressor operation rate so as to control the driving of the compressor; and a heat generating lamp provided in the chilling chamber of the refrigerating apparatus and configured to emit heat according to a control signal, wherein the microcomputer is further configured to operate the heat generating lamp and the compressor when the calculated compressor operation rate is greater than or equal to the predetermined compressor operation rate.

7. The device of claim 6, wherein the operation rate of the compressor corresponds to a rate of the temperature detecting signal output by the temperature detecting unit.

8. The apparatus of claim 6, wherein the microcomputer is further configured to stop operation of the heat generating lamp when the calculated compressor operation rate is less than the predetermined compressor operation rate.

9. The apparatus of claim 8, wherein the microcomputer is further configured to control sustained operation of the compressor based on the temperature detecting signal generated by the temperature detecting unit.

10. A temperature control device of a refrigerating apparatus, comprising:

a temperature setting unit configured to set a temperature of a chilling chamber and a freezing chamber according to a users demand;

a temperature detecting unit installed in the chilling chamber of the refrigerating apparatus and configured to output a temperature detecting signal when a temperature of the chilling chamber exceeds a predetermined temperature; and a microcomputer configured to control a driving of the compressor installed in the refrigerating apparatus based on the temperature detecting signal output by the temperature detecting unit, wherein the operation rate of the compressor is based on a rate transmitted by the temperature detecting signal, or to calculate an operation rate of the compressor and output a control signal based on the calculated compressor operation rate so as to control the driving of the compressor.

11. The apparatus of claim 10, wherein the microcomputer is further configured to control operation of the compressor based on a comparison of the calculated operation rate of the compressor and a predetermined operation rate of the compressor.

12. The device of claim 10, further comprising a heat generating lamp provided in the chilling chamber of the refrigerating apparatus and configured to emit heat according to a control group.

13. The apparatus of claim 12, wherein the microcomputer is further configured to operate the heat generating lamp and the compressor when the calculated compressor operation rate is greater than or equal to the predetermined compressor operation rate.

14. The apparatus of claim 13, wherein the microcomputer is further configured to stop operation of the heat generating lamp when the calculated compressor operation rate is less than the predetermined compressor operation rate, and to control sustained operation of the compressor based on the temperature detecting signal generated by the temperature detecting unit.

15. The apparatus of claim 10, wherein the microcomputer is further configured to determine a relative measure of an air temperature outside the refrigerating apparatus based on a comparison of the calculated operation rate of the compressor and the predetermined operation rate.

16. A method for controlling a temperature of a freezing chamber and a chilling chamber of a refrigerating apparatus having a compressor and a heat generating lamp, the method comprising:

calculating an operation rate of the compressor;

comparing the calculated operation rate of the compressor to a predetermined operation rate;

determining that a peripheral temperature of the refrigerating apparatus is low and operating the compressor when the calculated operation rate of the compressor is less than the predetermined operation rate; and operating the compressor based on a temperature detecting signal output by a temperature detecting unit installed in the chilling chamber and stopping operation of the heat generating lamp when the calculated operation rate of the compressor is greater than the predetermined operation rate, wherein the operation rate of the compressor is based on a rate of the temperature detecting signal output by the temperature detecting unit.

17. A device for controlling operation of a refrigerating apparatus which controls a compressor and a fan based on a temperature detecting signal output by a temperature detecting unit installed in a chilling chamber of the refrigerator apparatus, the device comprising:

a lamp installed in the chilling chamber and configured to emit heat based on a control signal so as to increase a temperature of the chilling chamber; and a microcomputer configured to calculate an operation rate of the compressor, to infer an outside air temperature of the refrigerating apparatus based on the calculated operation rate and a predetermined operation rate, to output a control signal to the lamp when the outside air temperature is determined to be low, and to drive the compressor based on the temperature detecting signal generated by the temperature detecting unit when the temperature detecting unit detects a temperature of the chilling chamber increased by the lamp.

18. The device of claim 17, wherein the microcomputer is configured to determine that an outside air temperature of the refrigerating apparatus is low when the calculated operation rate of the compressor is less than the predetermined operation rate, to output a corresponding control signal to the lamp, to receive the temperature detecting signal from the temperature detecting unit which detects an increased temperature of the chilling chamber due to operation of the lamp, and to operate the compressor based on the received temperature detecting signal.

19. The device of claim 18, wherein the microcomputer is configured to operate the compressor and to stop operation of the lamp based on the temperature detecting signal output by the temperature detecting unit installed in the chilling chamber when the calculated operation rate of the compressor is greater than the predetermined operation rate.

* * * * *